US005185632A

United States Patent [19]

Yoshida et al.

[11] Patent Number: 5,185,632

[45] Date of Patent: Feb. 9, 1993

[54] DEVELOPING DEVICE USING DEVELOPER REGULATING BLADE HAVING TWO CURVED PORTIONS

[75] Inventors: Minoru Yoshida, Tokyo; Kouji Hirano, Kanagawa, both of Japan

[73] Assignee: Kabushiki Kaisha Toshiba, Kawasaki, Japan

[21] Appl. No.: 774,187

[22] Filed: Oct. 10, 1991

[30] Foreign Application Priority Data

Oct. 30, 1990 [JP] Japan ..... 2-292753

[51] Int. Cl.[5] ..... G03G 15/00

[52] U.S. Cl. ..... 355/261; 118/651; 118/661; 355/259

[58] Field of Search ..... 355/251, 253, 245, 259, 355/261; 118/657, 658, 651, 661

[56] References Cited

U.S. PATENT DOCUMENTS

| | | | |
|---|---|---|---|
| 4,521,098 | 6/1985 | Hosoya et al. | 118/651 X |
| 4,908,291 | 3/1990 | Fuma et al. | 118/657 X |
| 4,920,916 | 5/1990 | Mizuno et al. | 118/261 X |
| 4,990,959 | 2/1991 | Yamamuro et al. | 355/245 |
| 5,057,868 | 10/1991 | Sekino et al. | 355/251 X |

FOREIGN PATENT DOCUMENTS

| | | | |
|---|---|---|---|
| 0017774 | 1/1987 | Japan | 355/259 |
| 1-191878 | 8/1989 | Japan . | |
| 0221968 | 9/1990 | Japan | 355/259 |

OTHER PUBLICATIONS

Hosoya et al.; Contact-Type Development System Using Monocomponent Nonmagnetic Toner; Toshiba R&D Center, Toshiba Corp., R&D Lab., Tokyo Electric Co., Ltd.; Jul. 5, 1989; pp. 25/28.

*Primary Examiner*—A. T. Grimley
*Assistant Examiner*—Robert Beatty
*Attorney, Agent, or Firm*—Foley & Lardner

[57] ABSTRACT

A device for developing a latent image on a photosensitive drum in an image forming apparatus, includes a developing roller for supplying a developing agent to the image carrier and a blade for forming a layer of the developing agent on the developing roller. The blade has a curved portion pressing the surface of the developing roller for controlling the thickness of the developing agent layer and for applying a frictional charge to the developing agent on the developing roller. The curved portion includes a first curved surface having a first radius R1 which contacts the surface of the developing roller and a second curved surface having a second radius R2. The relationship between the first and second radius is R1>R2.

13 Claims, 5 Drawing Sheets

DEVELOPING DEVICE USING DEVELOPER REGULATING BLADE HAVING TWO CURVED PORTIONS

BACKGROUND OF THE INVENTION

1. Field of the Invention

The present invention relates to a developing device in which an electrostatic latent image formed on an image carrier is converted into a visible image in an image forming apparatus such as an electrophotographic apparatus or electrostatic recording apparatus.

2. Description of the Related Art

The two-component developing method is well known. In the two-component developing device, a two-component developing agent is used. The two-component developing agent comprises a mixture of coloring particles, called toner particles, and magnetic particles, called carrier particles. The toner particles are adhered to an electrostatic latent image formed on an image carrier by electrostatic force. By this means, the electrostatic latent image is converted into a visible image.

However, this two-component developing method has problems, in that there is a tendency for the developing device itself to be larger, and also that fine adjustment of the mixture ratio of the toner particles and carrier particles is necessary. Therefore, a one-component developing method which does not require carrier particles is now most often used in copiers and compact printers.

An impression development method is one type of one-component developing method. This method is characterized in that the transporting of toner particles charged by friction to the developing area is achieved by causing toner particles to adhere to the surface of a developing roller. Since no magnetic carrier particles are required, there are many advantages; for example, simplification and miniaturization of the apparatus, and easy use of color toner particles.

In this imression development method, the toner particles adhering to the developing roller are formed into a thin layer. The thin layer of toner particles is made by controlling the amount of toner particles transported using a blade, the blade being in pressure contact with the developing roller. After this, the latent image is rendered visible by bringing the developing roller close to or into pressing contact with the image carrier. The blade is formed of a thin spring plate. As shown in Japanese Patent Disclosure (Kokai) No. 1-191878 (Disclosed on Aug. 1, 1989), on the leading edge of the blade, a curved portion, with a semicircular cross-sectional shape, is formed. By making the cross-section of curved portion semicircular in this way, a toner collecting space is formed between the curved portion and the surface of developing roller. The design is such that the curved portion is pushed upward by the collection of toner particles in the space so that approximately the specified quantity of toner particles passes between the developing roller and the curved portion.

However, in this type of developing device with the blade having a semicircular cross-section curved portion, over a long period of use the toner collecting space becomes shallower, due to wear of the surface of curved portion. Therefore the quantity of toner particles passing between the developing roller and the curved portion is reduced, due to reduction of upward pressure on the curved portion. As a result, deviations from the correct values of the toner charge and layer thickness occur. Therefore, the problem arises of not being able to obtain a high quality image.

SUMMARY OF THE INVENTION

It is an object of the present invention to provide a developing device which is capable of inhibiting as far as possible the effect of wear of the pressure contact portion of the blade on image quality.

According to the present invention there is provided a device for developing a latent image on an image carrier in an image forming apparatus, comprising roller means for supplying a developing agent to the image carrier; and means for forming a layer of the developing agent on the roller means, the forming means having a curved portion pressing on the suface of the roller means for controlling the thickness of the developing agent layer and for applying a frictional charge to the developing agent on the roller means, the curved portion comprising a first curved surface having a first radius R1 which contacts the surface of the roller means and a second curved surface having a second radius R2 opposed to the first curved surface and provided at the upstream side in the rotational direction of the roller means, the relationship between the first and second radius being $R1 > R2$.

DETAILED DESCRIPTION OF THE PREFERRED EMBODIMENT

Referring to the acompanying drawings, a detailed description will subsequently be given of the preferred embodiment of the present invention.

Figure 1:
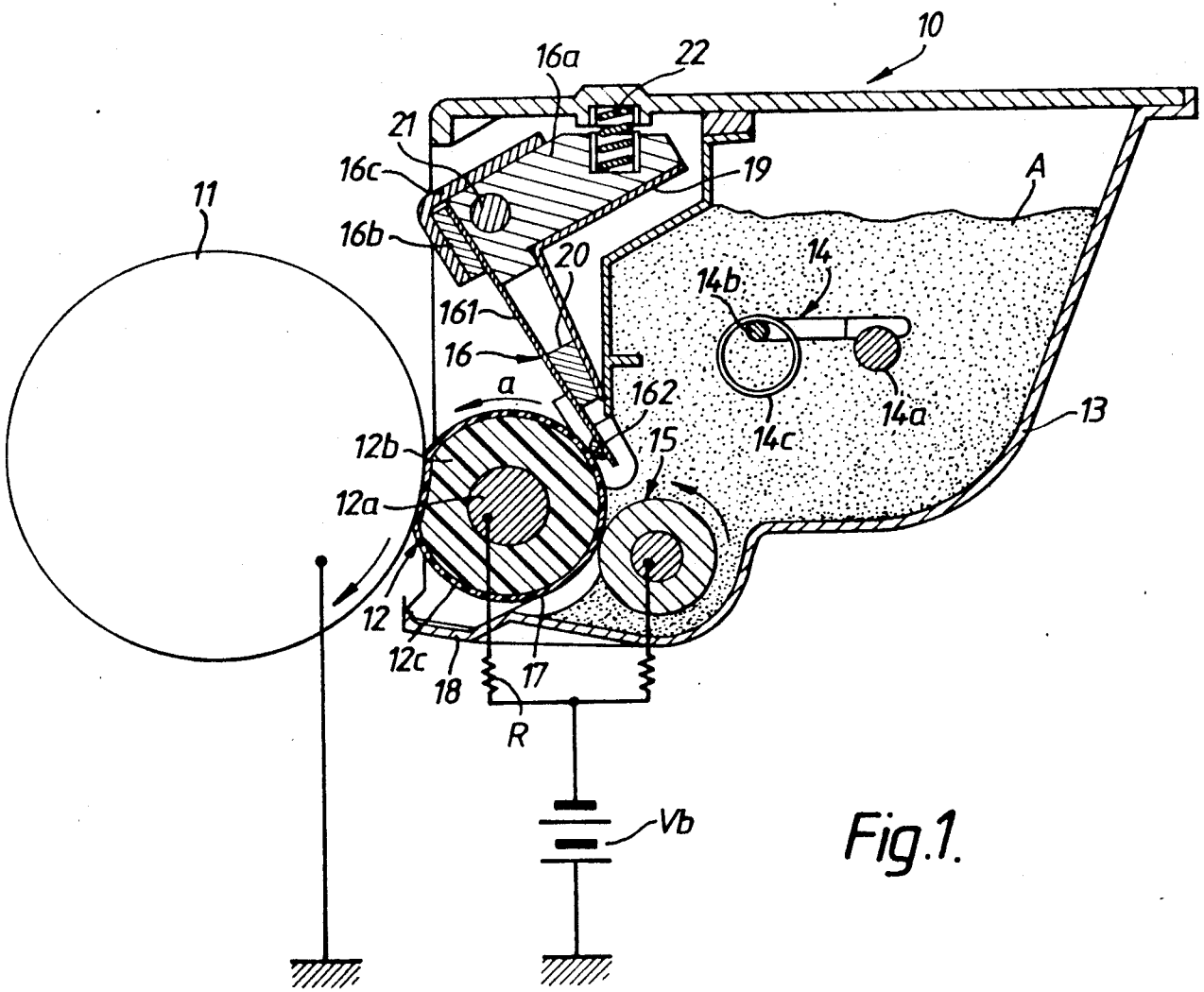
FIG. 1 is a cross-section view showing the overall composition of a developing device of an embodiment of the present invention.

FIG. 1 is a cross-section view showing the overall composition of a contact type one-component non-magnetic developing device (hereafter, simply 'developing device') which is an embodiment of the present invention.

As shown in FIG. 1, developing device 10 comprises developing roller 12, toner storage 13, mixer 14, toner supply roller 15 and blade 16. Developing roller 12 converts an electrostatic latent image into a visible image by transferring non-magnetic toner (hereafter, simply 'toner') A as a developing agent on to the electrostatic latent image formed on the surface of photosensitive drum 11. Toner storage 13 contains toner A. Mixer 14 is arranged in toner storage 13 to agitate toner A for supplying toner A toward supply roller 15 and preventing the coagulation of toner A. Mixer 14 comprises rotational axis 14a, mounting bar 14b fixed to rotational axis 14a and coil spring 14c mounted to mounting bar 14b. Toner supply roller 15 supplies toner A, which is stored in toner storage 13, to developing roller 12. Blade 16 forms a thin toner layer on the surface of developing roller 12.

The developing process in developing device 10 will now be described.

Toner A stored in toner storage 13 is transported in the direction of toner supply roller 15 while being agitated by mixer 14, and is then supplied to developing roller 12 by toner supply roller 15. Toner A is negatively charged by friction with the surface of rotating developing roller 12 and is transported by being electrostatically adhered to the surface of developing roller 12. Then, the amount of toner A which is adhered to the surface of developing roller 12 and transported in the direction of arrow a is regulated by blade 16 and is formed into a thin layer. At the same time, toner A is recharged by the friction between developing roller 12 and blade 16, and is transported as a fine toner layer. After this, toner A adhered to the surface of developing roller 12 is transferred to the electrostatic latent image on the surface of photosensitive drum 11 by contact with photosensitive drum 11. By this means, the electrostatic latent image is converted into a visible image. Any toner A on the surface of developing roller 12 which has not been transferred passes through between recovery blade 17 and the surface of developing roller 12 and returns to toner storage 13.

In this embodiment, since the reversal development technique which uses negatively-charged organic photosensitive drum 11 is adopted, negatively-charged toner is used as toner A, and a material which easily negatively charges toner A is used as blade 16. The surface potential of photosensitive drum 11 is −550 [V]. As against this, a developing bias voltage Vb of −200 [V] is applied to metallic shaft 12a of developing roller 12 via protective resistor R. Developing roller 12 always has a contact width (developing nip) of about 1–4 [mm] on the surface of photosensitive drum 11, and developing roller 12 rotates at a speed of approximately 1.2–4 times the speed of rotation of photosensitive drum 11.

In the above developing process, the inside of the image forming apparatus or the copying paper will be soiled if toner A drops from developing roller 12 for any reason. Therefore, in this embodiment, toner receiving member 18, made of a plasticizer which will recline toner A, is installed in the lower part of developing device 10. By this means, the scattering of toner A can be prevented, even if the developing device is placed upside down.

A trailing edge portion of blade 16 is supported on the device main body by first blade holder 16a, spacer 16b and second blade holder 16c. Baffle plate 19 is mounted on first blade holder 16a to sandwich foaming agent 20, such as moltopren, between this baffle plate 19 and the rear surface of blade 16. By sandwiching foaming agent 20 between baffle plate 19 and blade 16 in this way, leaks of toner A from toner storage 13 and the vibration of blade 16 is prevented.

In order to press with suitable force the surface of developing roller 12 with its curved portion 162 formed on the leading edge portion, blade 16 is always energized by multiple compression springs 22, using rotating shaft 21 as a fulcrum.

Figure 2:
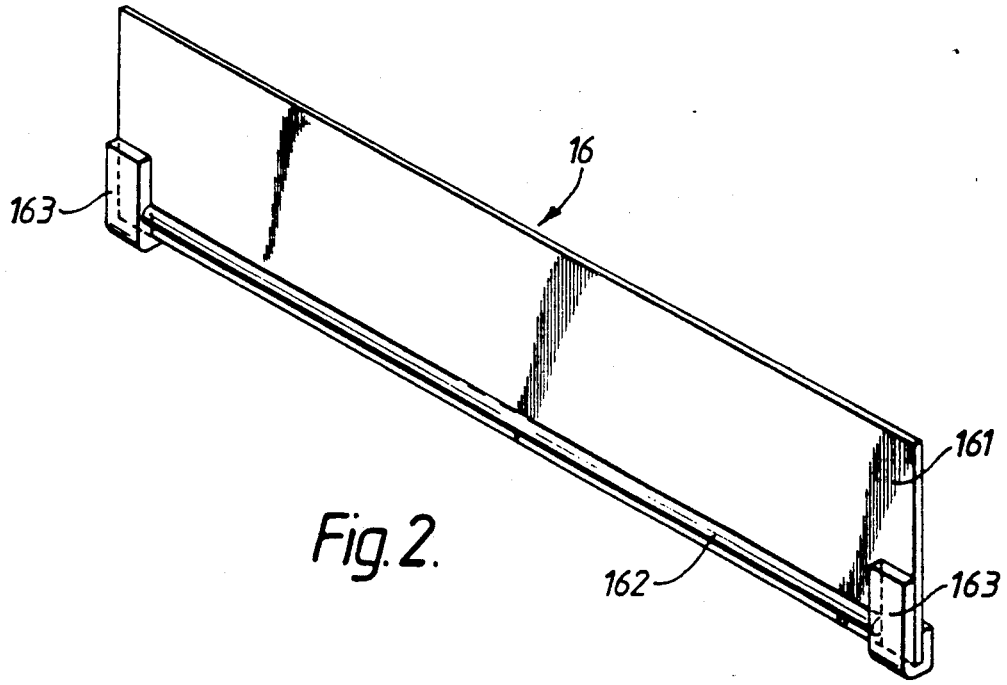
FIG. 2 is a perspective view showing the details of the blade in the developing device in FIG. 1.

As shown in FIG. 2, blade 16 is constructed as follows. Curved portion 162 made of, for instance, an elastic member such as silicon rubber, silicon resin, urethane rubber or urethane resin with a JIS-A hardness of 30°–85° is mounted in the longitudinal direction on the leading edge of thin spring plate 161 made of, for instance stainless steel, beryllium copper, phosphor bronze, or the like. Seals 163; made of urethane foam or the like, are bonded to each end.

Figure 3:
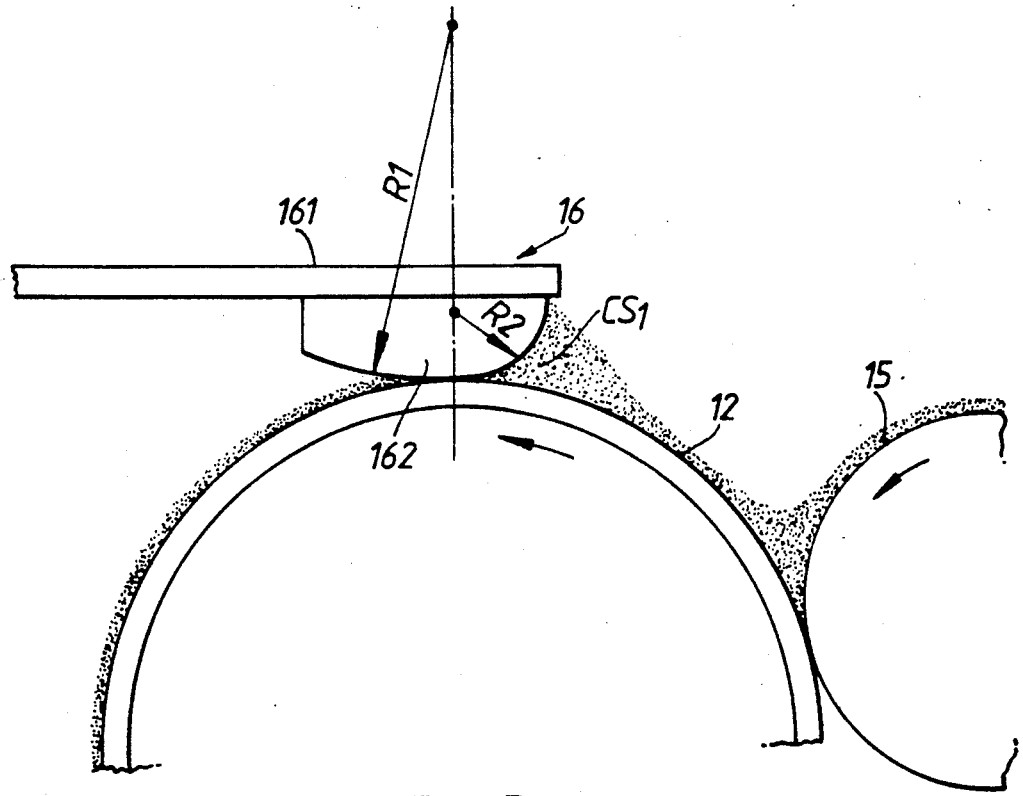
FIG. 3 is a cross-section view showing the details of the curved portion of the blade in FIG. 2.

In this embodiment, thin spring plate 161, made of stainless steel of thickness 0.15 [mm], is used, and silicon rubber with a JIS-A specification of 80° is used for curved portion 162. As shown in FIG. 3, curved portion 162 has two curved surfaces on the surface facing developing roller 12, each having its center point on the same straight line. That is, it has a first curved surface of radius R1 (20 [mm]) in contact with developing roller 12 and a second curved surface of radius R2 (1 [mm]) which forms toner collecting space $CS_1$ between the second curved surface of the curved portion 162 and the surface of developing roller 12. It has been confirmed by tests, when the relationship between radius R1 [mm] of the first curved surface and radius R2 [mm] of the second curved surface is within limits which satisfy the relationship in the following equation, the effect due to wear of curved portion 162 on the image is of a level which can be ignored.

$$R1 \geqq R2 \times 5$$

Seals 163 are thicker than the height of curved portion 162, as shown in FIG. 2. Seals 163 are mounted on thin spring plate 161 so that the positions of their leading edges project further towards developing roller 12 than the leading edge of curved portion 162. By this means, the escape of toner from the both ends of blade 16 can be reliably prevented when curved portion 162 is pressed on the surface of developing roller 12. Since seals 163 are mounted so that they sandwich the ends of thin spring plate 161, there is no risk of their peeling off, even though they are subject to the toner transport pressure.

Figure 4:
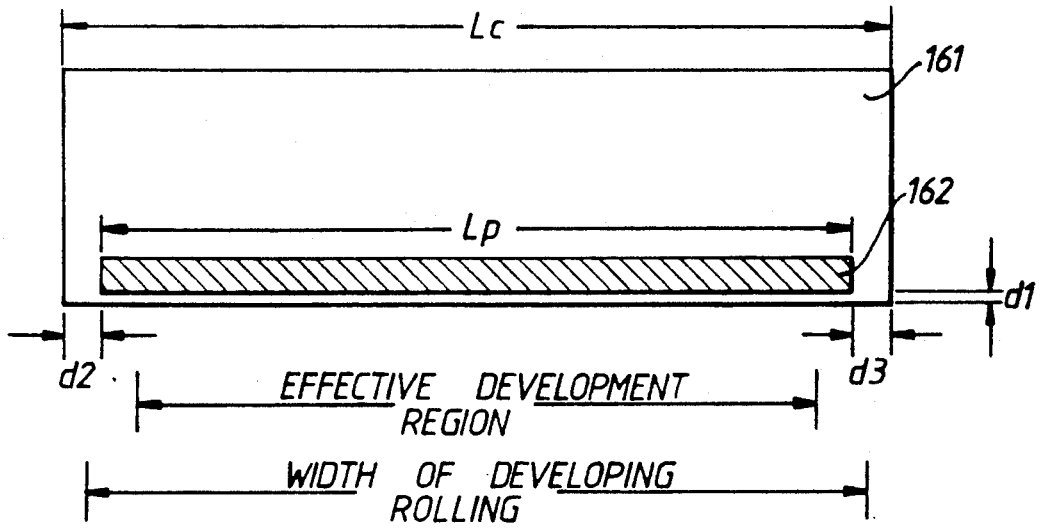
FIG. 4 is a front view of the blade in FIG. 2.

As shown in FIG. 4, curved portion 162 is mounted in a position in which curved portion 162 is separated from the leading edge of thin spring plate 161 by d1. That is, the leading edge portion of thin spring plate 161 is used for pressing and position determination when curved portion 162 is mounted by bonding to thin spring plate 161. By this means, both the mounting accuracy of curved portion 162 and the accuracy in the tangential direction between developing roller 12 and curved portion 162 can be improved. Incidentally, if d1 is made too large, there will be a risk of defects in toner layer formation on developing roller 12 due to pressure by the toner flow. Therefore, 0.5–5 [mm] is suitable. Preferably, the optimum is 0.5–2 [mm]. There are portions at both ends in the longitudinal direction of thin spring plate 161 where curved portion 162 is not mounted. Seals 163 are bonded in these portions. That is, the length Lp of curved portion 162 in the longitudinal direction is shorter than the length Lc of thin spring plate 161 by d2+d3. When taking account of sealability, the length of d2+d3 requires a minimum of 3 [mm] at each end. When this length is too long, developing device 10 itself becomes larger. Therefore, it is desirable that it should be 8–30 [mm], and preferably 6–20 [mm]. The length Lp of curved portion 162 at this time is longer than the width of effective development region.

The length Lc of thin spring plate 161 is determined as equal to the width of developing roller 12, or long enough to touch the side seals (not shown) of developing roller 12.

Figure 5:
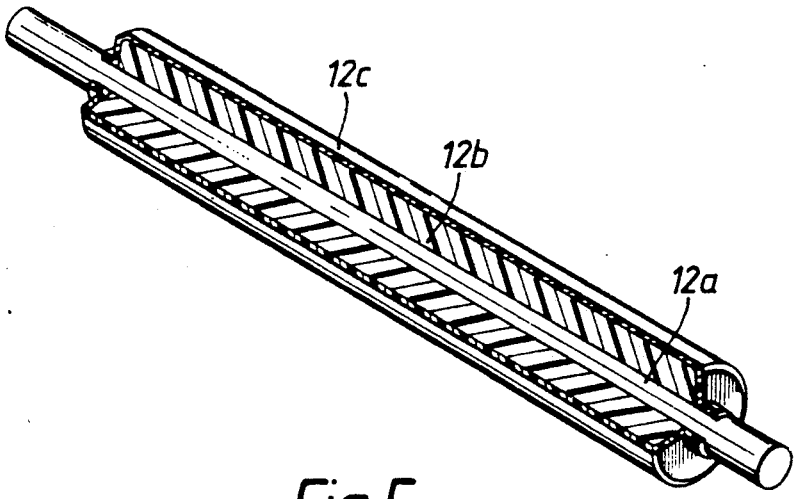
FIG. 5 is a perspective cross-section view showing the structure of the developing roller in the developing device in FIG. 1.

A detailed description of developing roller 12 will now be described with referring to FIG. 5.

The characteristics required for developing roller 12 are conductivity and elasticity. As the simplest structure which will satisfy this, for example, a conductive rubber roller covering the outer periphery of a metal shaft can be used. However, in the developing device of this embodiment, smoothness of the surface is required because the toner is transported while in pressure contact with the surface of developing roller 12. Therefore, developing roller 12 of this embodiment has a two-layer construction by providing elastic layer **12*b* made of, for instance, conductive silicon rubber or urethane rubber around the periphery of metallic shaft 12*a* as a base member, and further providing conductive polyurethane type layer 12*c* on the surface of this elastic layer 12*b***.

Conductive layers or non-conductive layers may be considered as elastic layer **12*b*. However, a conductive layer is preferable when taking account of the case of peeling or damage occurring in conductive layer 12*c***.

The rubber hardness of elastic layer **12*b* is an essential factor which has a direct influence on the load and the torque of developing roller 12 in order to give a suitable nip width between developing roller 12 and photosensitive drum 11. In addition, permanent distortion [%] noted in JIS K6301 due to packaging and long-time holding is a significant problem. If the distortion exceeds 10 [%], a density non-uniformity due to developing roller cycles appears on images. Thus, the permanent compression distortion [%] of elastic layer 12*b*** must be limited to 10 [%] or less, and preferably 5 [%] or less. The relationship between the rubber hardness and the permanent distortion has the general tendency that the higher the rubber hardness, the less the permanent distortion. Therefore, a mutual balance with the material becomes important.

In this embodiment, conductive silicon rubber was selected as satisfying the above properties required for elastic layer **12*b***. However, any substance which satisfies the required properties, such as conductive EPDM rubber or conductive urethane rubber can be used.

Elastic layer **12*b*, made of conductive silicon, has a hardness of 28° by the A-type hardness meter of JIS specification K6301, and its external diameter as an elastic roller is 18 [mm]. The electrical resistance value of the conductive silicon is $3.4\times10^3$ [Ω.cm]. This result is calculated from the measurement of the observed current when this elastic roller was positioned parallel to a roller made of stainless steel of diameter 60 [mm], so that the contact width was 2 [mm], and a potential difference of 100 [V] was set between the metal shafts of the two rollers. Moreover, the permanent distortion of elastic layer 12*b*** made of conductive silicon is 1.8 [%], when measured by the measurement method indicated in JIS specification K6301.

Since conductive layer **12*c* contacts the toner and photosensitive drum 11 directly, layer 12*c* must be prevented from contaminating the toner and photosensitive drum 11 owing to exuding of plasticizer, curing agent, process oil, etc. It is desirable that the maximum surface roughness should be less than 3 [μm] for the smoothness of the surface of conductive layer 12*c*. If the surface roughness is greater than this value, the roughness of the surface of layer 12*c*** is liable to appear on images as uneven patterns.

As a method of achieving a smoothness of conductive layer **12*c* which is less than the maximum surface roughness of 3 [μm], the method of attaching a conductive layer 12*c* having sufficient film thickness on elastic layer 12*b*** and then finishing it to the specified outer diameter and surface roughness by after-treatment (polishing) may be considered. However, this method would be costly.

Therefore, a method of finishing without requiring after-treatment is desired. For this purpose, the viscosity of coating for the surface roughness of elastic layer **12*b*, the film thickness of conductive layer 12*c* and the formation of conductive layer 12*c* must be selected at the optimum conditions. That is, the lower the viscosity of the coating and the greater the surface roughness of elastic layer 12*b*, the greater must be the film thickness of conductive layer 12*c*. The viscosity of the coating material for forming conductive layer 12*c* must be varied (by altering the rate of dilution), even if the coating material is unchanged, in accordance with the method of coating the material on the surface of elastic layer 12*b***.

Developing device 10 in which developing roller 12 was assembled was mounted in a laser beam printer. Reversal development was excuted with the following settings:

image portion potential, that is, the exposed portion potential is −80 [V];

non-image portion potential, that is, the unexposed portion potential is −500 [V];

developing bias voltage is −200 [V];

contact width of photosensitive drum 11 and developing roller 12 is 1.5 [mm]; and peripheral speed ratio of photosensitive drum 11 and developing roller 12 is 1:2.

The result was that, with an image density of 1.4, print samples having very sharp line images with absolutely no fogging and uniform solid images with no randomness were obtained. Also the result of carrying out a 10,000-sheet life test was that, even after its completion, excellent quality images, equivalent to the initial images, could be obtained.

Figure 6:
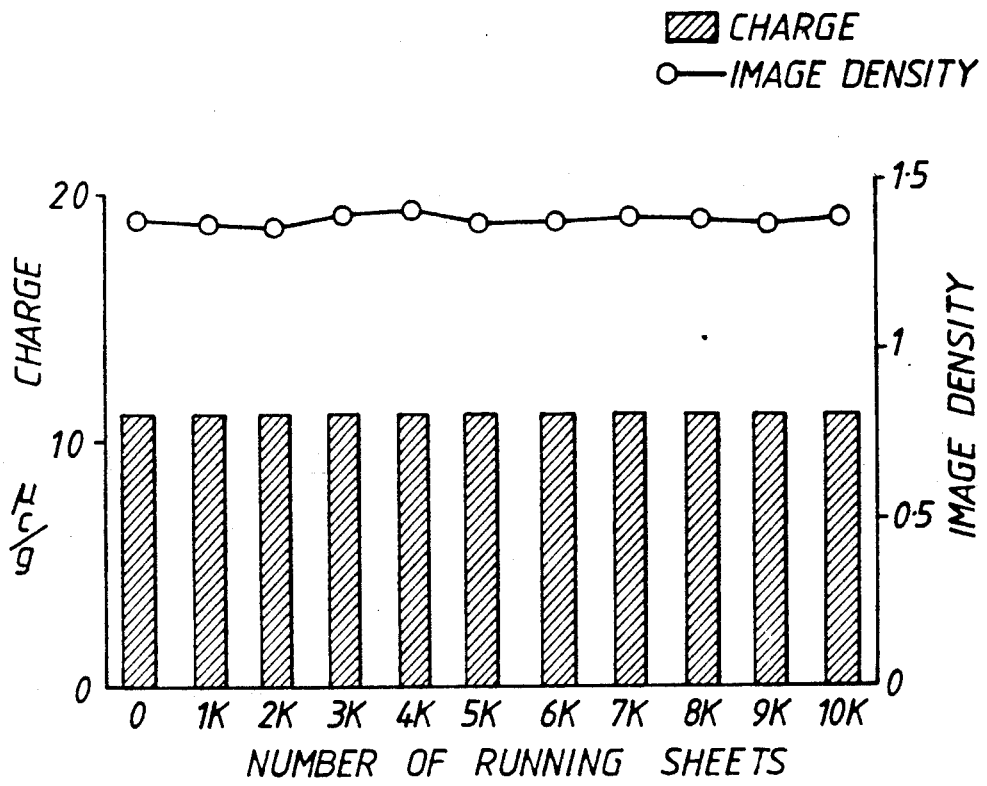
FIG. 6 is a graph showing the results of variation of image density and charge by carrying out a life test using the developing device of this embodiment.

FIG. 6 is a graph showing the variation of image density and toner charge from start to 10,000 sheets. A solid image was used for measuring image density. For the toner charge, the 10-rotation charge of developing roller 12 was measured, using a charge measurement device. From this graph, it found that the image density was hardly changed, even after 10,000 sheets. The charge also hardly varied.

In this way, using the developing device of this embodiment, a first curved surface in contact with developing roller 12 and a second curved surface with a smaller radius than the first curved surface for forming toner collecting space $CS_1$ between it and developing roller 12 are provided on curved portion 162 of blade 16 on the surface developing roller 12. Therefore, a developing device in which there is very little effect on image quality due to wear of curved portion 162 can be achieved.

Figure 7:
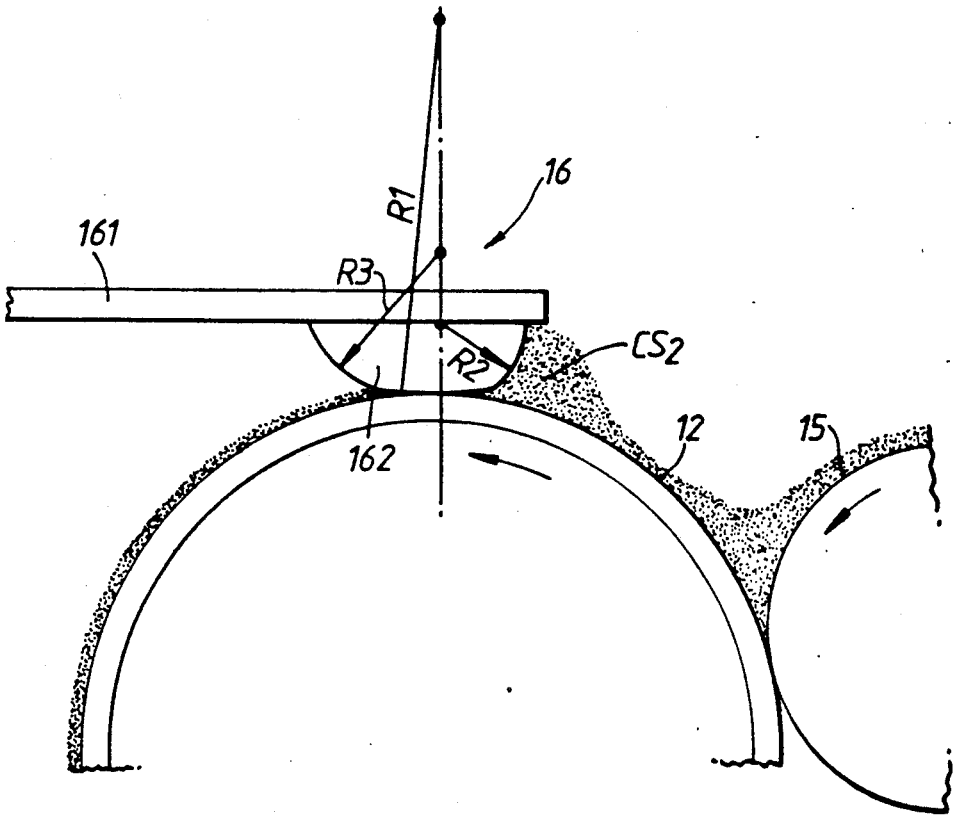
FIGS. 7 and 8 are cross-section views, each showing a modified version of the curved portion shape of the blade.
Figure 8:
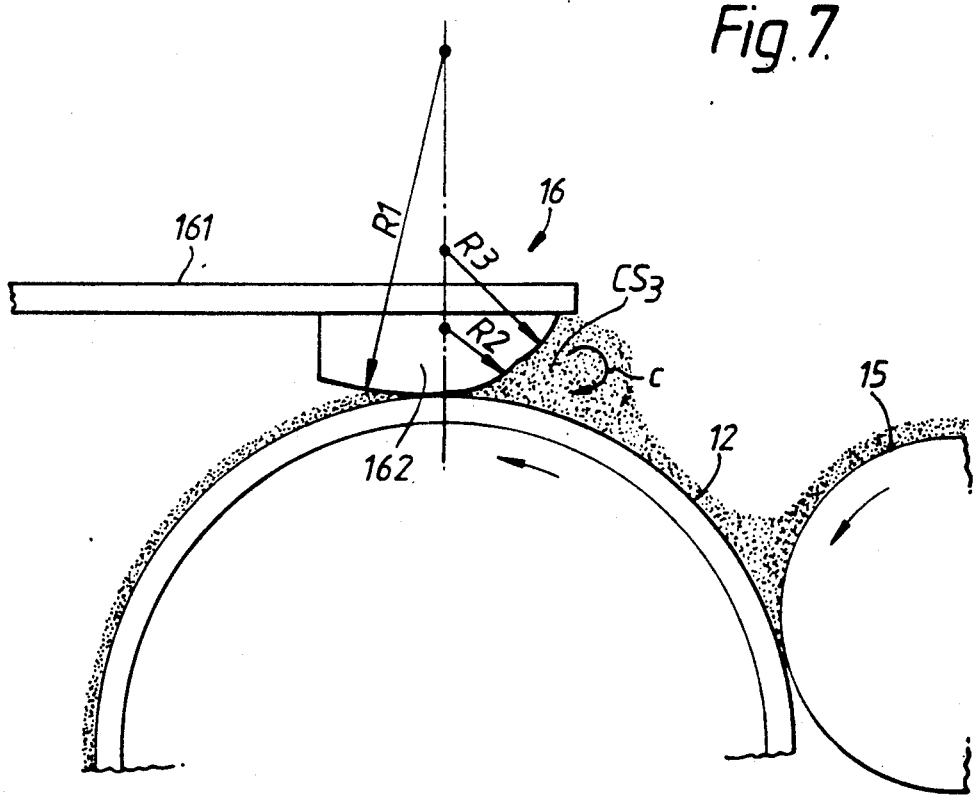

As modified versions of the shape of curved portion 162, the types of curved portion shown in FIGS. 7 and 8 can be used. That is, curved portion 162 of blade 16 shown in FIG. 7 is constructed by providing three curved surface facing developing roller 12 which each have their centers on the same straight line. The radius R1 of the first curved surface, which is in contact with developing roller 12, is made 30 [mm]. The radius R2 of the second curved surface, which forms toner collecting space $CS_2$ between it and the surface of developing roller 12, is made 1 [mm]. The radius R3 of the third curved surface, which is provided on the opposite side to the second curved surface, thus sandwiching the first curved surface, is made 2 [mm].

Curved portion 162 of blade 16 shown in FIG. 8 is also constructed by providing three curved surface facing developing roller 12 which each have their centers on the same straight line. The radius R1 of the first curved surface, which is in contact with developing roller 12, is made 30 [mm]. The radius R2 of the second curved surface, which forms toner collecting space $CS_3$ between it and the surface of developing roller 12, is made 1 [mm]. The radius R3' of the third curved surface is made 2 [mm]. This third curved surface of the radius R3' is continued from the second curved surface of the radius R2 so as to face toner collecting space $CS_3$. By providing this third curved surface facing toner collecting space $CS_3$, the toner collected in this portion can be circulated in the direction C to agitate. As a result, the toner is electrically charged by the action of friction.

The developing device of this embodiment operates reversal development using a negative-charged organic photosensitive body for photosensitive drum 11. However, the present invention can also be applied to developing devices which perform normal development using positively-charged organic photosensitive bodies or inorganic photosensitive bodies.

Also, in this embodiment, blade 16 is supported in the 'against' position with respect to the rotation of developing roller 12. However, it may also be supported in the 'with' position with respect to the rotation of developing roller 12.

Moreover, the present invention can also be applied to a developing device of the type in which developing roller 12 and photosensitive drum 11 are not in contact.

According to the present invention, even if the pressure contact portion of the blade is worn due to contact with the developing roller, the effect on the shape of the developing agent collect space between the pressure contact portion and the developing roller is very small. As a result, it is possible to achieve a developing device in which image defects, such as reduction of image density or density randomness, hardly occur, even if the developing device is used for long periods.

What is claimed is:

1. A device for developing a latent image on an image carrier in an image forming apparatus, comprising:

roller means for supplying a developing agent to an image carrier; and means for forming a layer of the developing agent on the roller means, the forming means having a curved portion pressing on the surface of the roller means for controlling the thickness of the developing agent layer and for applying a frictional charge to the developing agent on the roller means, the curved portion comprising a first curved surface having a first radius R1 which contacts the surface of the roller means and a second curved surface having a second radius R2 provided at the upstream side in the rotational direction of the roller means, the relationship between the first and second radii being $R1 > R2$.

2. The device according to claim 1, wherein the forming means includes a collecting space, which is formed between the second surface of the curved portion and the surface of the roller means, for collecting the developing agent supplied by the roller means.

3. The device according to claim 1, wherein the relationship between the first radius R1 and second radius R2 is $R1 \geqq R2 \times 5$.

4. The device according to claim 1, wherein the forming means includes a blade having a trailing edge portion, a leading edge portion opposed to the trailing edge portion and two end portions.

5. The device according to claim 4, wherein the blade includes a material selected from the group consisting of stainless steel, beryllium copper and phosphor bronze.

6. The device according to claim 4, wherein the forming means includes a pair of seal members mounted to both end portions of the blade to prevent escape of the developing agent from the end portions of the blade.

7. A device for developing a latent image on an image carrier in an image forming apparatus, comprising:

means for supplying a developing agent to an image carrier; and means for forming a layer of the developing agent on the supplying means, the forming means having a curved portion pressing on the surface of the supplying means for controlling the thickness of the developing agent layer and for applying a frictional charge to the developing agent on the supplying means, the curved portion having first and second curved surfaces, each having its center point on the same straight line, the first curved surface having a first radius R1 which contacts the surface of the supplying means and the second curved surface having a second radius R2, which forms a collecting space between the second surface and the surface of the supplying means, for collecting the developing agent supplied by the supplying means, the relationship between the first and second radii being $R1 > R2$.

8. The device according to claim 7, wherein the relationship between the first radius R1 and second radius R2 is $R1 \geqq R2 \times 5$.

9. The device according to claim 7, wherein the curved portion of the forming means further has a third curved surface having a third radius R3 which is provided on the side opposite the second surface.

10. The device according to claim 7, wherein the curved portion of the forming means further has a third curved surface having a third radius R3, which is continued from the second surface to face the developing agent collecting space.

11. The device according to claim 7, wherein the forming means includes a blade having a trailing edge portion, a leading edge portion opposed to the trailing edge portion and two end portions.

12. The device according to claim 11, wherein the blade includes a material selected from the group consisting of stainless steel, beryllium copper and phosphor bronze.

13. The device according to claim 11, wherein the forming means includes a pair of seal members mounted to both end portions of the blade to prevent escape of the developing agent from the both end portions of the blade.

* * * * *